United States Patent [19]

Daggett et al.

[11] Patent Number: 4,768,968

[45] Date of Patent: Sep. 6, 1988

[54] FUSE HOLDER BLOCK

[75] Inventors: Charles W. Daggett, Mt. Prospect; Julius A. Nemeth, Oak Park, both of Ill.

[73] Assignee: Littelfuse, Inc., Des Plaines, Ill.

[21] Appl. No.: 614,114

[22] Filed: May 24, 1984

Related U.S. Application Data

[63] Continuation-in-part of Ser. No. 293,605, Aug. 17, 1981, abandoned.

[51] Int. Cl.[4] ..... H01R 21/28

[52] U.S. Cl. ..... 439/246

[58] Field of Search ..... 339/59 R, 59 M, 64, 339/220

[56] References Cited

U.S. PATENT DOCUMENTS 1,864,283 6/1932 Steinmayer ..... 339/64 R 2,828,393 3/1958 Wingard ..... 339/220 R 3,813,637 5/1974 Trebik et al. ..... 339/59 R

*Primary Examiner*—Joseph H. McGlynn

*Attorney, Agent, or Firm*—Russell E. Hattis; Stephen R. Arnold

[57] ABSTRACT

An improved fuse holder for cartridge electrical fuses features snap-in terminal clips which engage the side barrier walls of a unitary insulating mounting base. The barrier side walls partially shroud the clips from accidental contact by external objects. The metal rivet normally used to secure a fuse clip to a base is eliminated, permitting a lower fuse holder profile for a given voltage requirement. Optional additional subsequent hot-forming of a clip-engaging post on the base provides extra pull strength to the structure. A limited rotation capability of the clips facilitates fuse insertion without breakage.

8 Claims, 3 Drawing Sheets

FIG. 1A
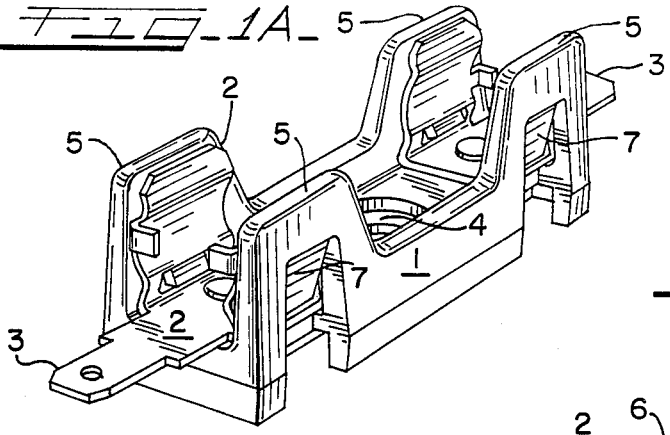
FIG. 2
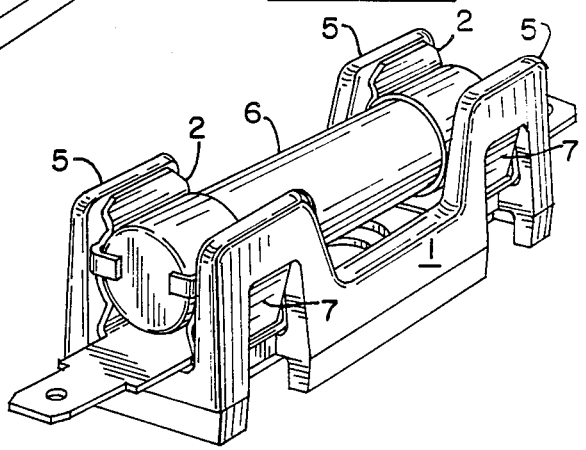
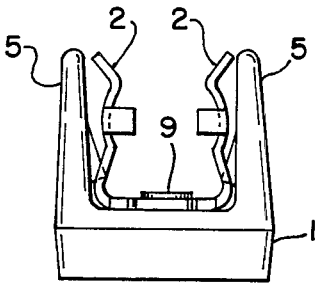
FIG. 1D
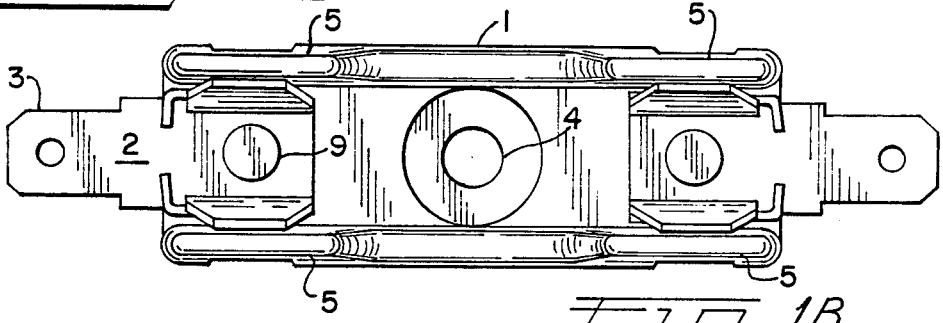
FIG. 1B
FIG. 1C
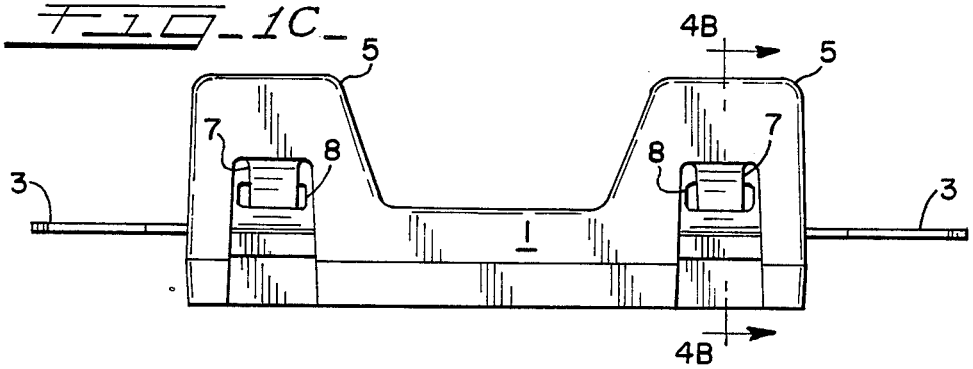

FIG. 3
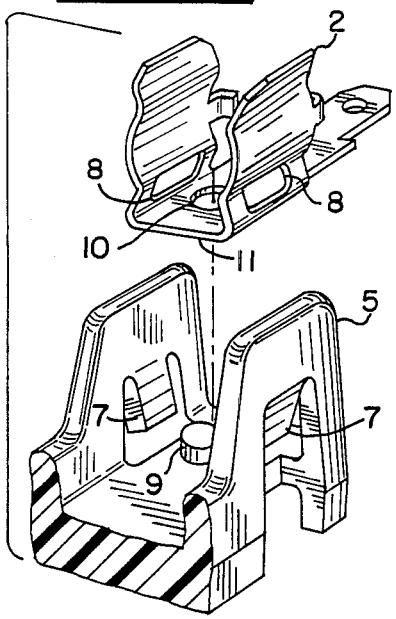
FIG. 4A
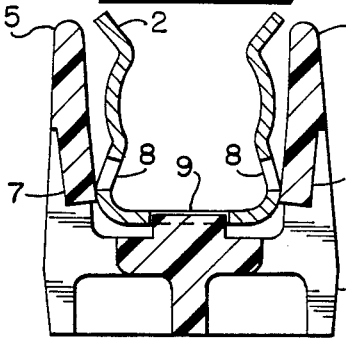
FIG. 4B
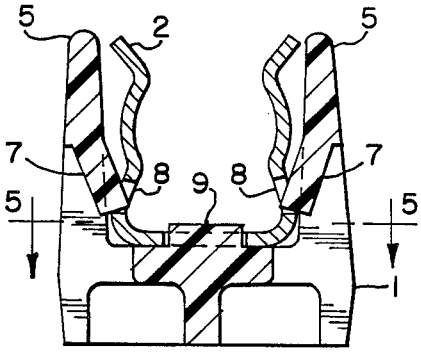
FIG. 5
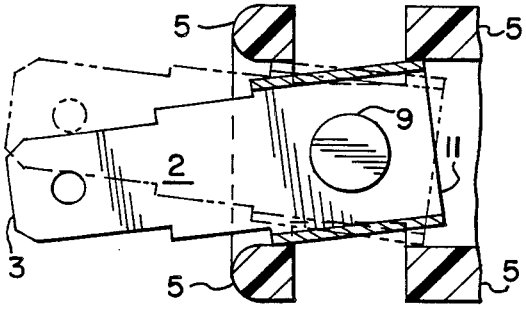
FIG. 6B
FIG. 6A
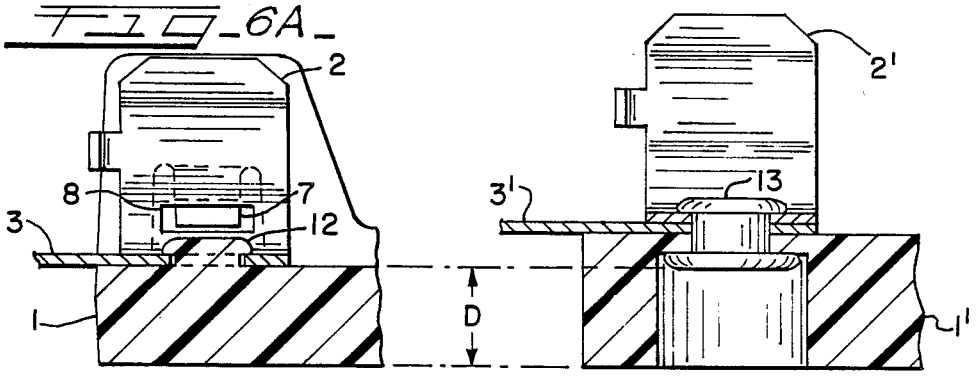

FUSE HOLDER BLOCK

RELATED APPLICATION

The present application is a continuation-in-part of application Ser. No. 293,605, filed Aug. 17, 1981 and entitled Fuse Holder Block, now abaondoned.

TECHNICAL FIELD

The subject matter of the invention is an improved clip-in holder for electrical fuses.

BACKGROUND OF PRIOR ART

Conventional clip-in fuse holders for cylindrical cartridge fuses exhibit certain deficiencies with respect to high voltage insulation protection. Such holders typically consist of a pair of spring clips mounted on a base and configured to engage the end terminals of a cylindrical cartridge fuse by pressing insertion. The clips, together with unitary or separate terminal lugs, are normally secured to the base by a metallic rivet, screw or bolt and nut passing through a hole in the clip base and through a matching hole passing through the mounting base. Since these fasteners are in electrical contact with the clips, a short circuit can occur through the clips and fasteners if the bottom faces of the fasteners are exposed below the mounting base to contact any conducting surface on which the fuse holder may be mounted.

One solution involves provision of a separate insulating spacer inserted between the fuse mount base and the supporting surface. This solution is undesirable, since it requires an extra part, raises the overall height of the fuse structure and, thus, wastes space and poses tailoring problems for multiple fuse mount arrays of differing numbers of fuses.

An alternative solution is to provide a relatively thick fuse mounting base and to counterbore the rivet hole at the lower face of the mounting base to place the lower end of the rivet higher in the structure. This solution has the drawback that the surface walls of the counterbore walls serve as surface flashover paths at high voltages unless the base thickness is appropriately increased, again resulting in increased overall height of the fuse mount. Additionally, the rivets are extra parts in the assembly, and thus add materially to the manufacturing inventory. Accordingly, it is an object of the invention to provide an inexpensive, easily assembled fuse mount with less parts and without conducting passages through the base so as to achieve a reduced structure height for a given voltage rating.

It is frequently observed that low-priced snap-in cartridge fuses have their end terminals oriented significantly off-axis. Such structures are typically rather fragile, owing to the customary method of end terminal attachment, and as a result the terminals frequently break off when such fuses are inserted into conventional fuse holders with rigidly coaxially aligned fuse clips. Accordingly, it is an object of this invention to provide for self-aligning clips as a feature of the fuse mount to accommodate off-axis end terminals without such breakage.

BRIEF SUMMARY OF THE INVENTION

In accordance with one of the features of the invention, an improved fuse holder for cartridge electrical fuses has a main unitary insulating base having one or more fuse holding stations each including a pair of clip mounting areas between which a cylindrical fuse is to extend. Each clip mounting area has a snap-in terminal clip comprising a base portion from which upwardly extend a pair of resilient laterally confronting jaws preferably made of sheet metal shaped to envelope the cylindrical fuse terminals which provide appreciable contact areas. This large areas of contact also provides for good heat dissipation. Extending upwardly at the lateral sides of each of the mounting areas are a pair of protective insulating side barrier walls which partially shroud the terminal clips and the terminals of the engaged fuse from accidentally touching contact with external objects. The terminal clips make snap-in locking engagement with the barrier walls, and thus do not require a conventional metal attaching fastener passing through the base. By eliminating the conducting rivet and its attendant potential for high voltage flashover to the surface on which the base is mounted, e.g. a fuse box wall, the base may be made thinner, resulting in an overall lower profile and reduced space requirements. Further, by reducing the number of components and replacing a riveting operation with a snap-in operation, manufacturing costs are reduced.

While the use of such barrier walls is not new, to my knowledge, because lateral expansion of the clips upon fuse insertion was contemplated requiring clearances between the side barrier walls and the clip, the use of these side barrier walls as clip snap-in retainer means was not to my knowledge heretofore utilized.

According to a specific aspect of the feature invention, the snap-in engagement is most advantageously secured by unitary downwardly extending resilient tabs on the interior faces of the barrier walls engaging and pressing down on suitably shaped portions of the clip jaws. (This snap-in engagement can be less desirably achieved by providing flexible fingers on the clip which make snap-in engagement behind shoulders on the barrier walls, and providing other outwardly deformable portion on the clips which receive and expand outward upon fuse insertion.)

According to another specific aspect of the invention, additional securing means is provided by a pair of pivot-forming posts unitary with said mounting base and extending therefrom to engage matching holes in the bases of each clip upon clip insertion. The combination of tab engaging means to press the clip against the mounting base and a capture post forming an integral extension of the insulating material of the insulating body to prevent lateral travel on the base provides an inexpensive easily-manufactured way of making a reliable fuse holder assembly. According to still another specific aspect of the invention, additional strength is achieved in the assembly by configuring the posts to pass through and beyond the clip bases. The extended portion of each post may be crowned over by conventional hot-forming techniques after clip insertion, thereby imparting additional pull strength protection during fuse removal.

Also, to enable the clips to self-align themselves to receive fuses with mis-aligned end terminals, the engaging portions of the barrier walls and clips are designed to enable relative pivotal movement therebetween, so that the clips can swivel on the posts.

The closest prior art to the present invention is believed to be U.S. Pat. No. 3,813,637, granted May 28, 1974 to Grebik et al which has snap-on terminal clips and omit metal rivets, but the design of and the manner of securing these clips and the relationship of the clips to side barrier walls is completely different from that of the present invention. Thus, this patent discloses a fuse holder comprising a body of insulating material defining a plurality of fuse-receiving cavities with pairs of laterally facing barrier-forming walls at opposite ends of the cavities. A fuse terminal engaging clip unit spanning all of the cavities is provided at each end of the insulating body, and each clip comprises a plurality of retainer members or bodies which are snap-fittable over retainer fingers at the corresponding ends of the associated cavities. The retainer bodies do not engage with the barrier-forming walls for clip retension purposes as in the case of the present invention, and clearances are formed therebetween to permit lateral expansion of the retainer bodies when a fuse is inserted into the fuse holder. Thus, the retainer bodies disclosed in the Grebik et al patent are complicated and non-conventional in shape, and include loops of metal which are engaged by the end faces of the fuse. It appears that only line contact is provided between the loops of metal and the fuse terminal end faces. The retainer bodies of each clip also form narrow edged upstanding recessed cradle supports for the bottom of the fuses supported thereby and probably have some flexibility to accommodate for some non-alignment in the fuse terminals. However, the clips do not freely pivot for greater ease of self-alignment with non-aligned fuse terminals as in the case with the preferred form of the invention. The engagement of the fuse terminals by the edges of the cradle supports and by the loops of the clips do not provide the desired large area of contact between the clips and the fuse terminals for good low resistance contact and heat dissipation, as is achieved by the confronting clip jaw surfaces used in the present invention.

U.S. Pat. No. 1,864,283, granted June 21, 1932, to Steinmayer, discloses a fuse holder without side barrier walls as claimed and a very complicated contact clip design which, while providing free clip movement, does not do so in the manner of the present invention. Thus, neither the Grebik et al nor the Steinmayer patents disclose the unique use of side barrier-forming walls as clip retainers and also where the barrier walls preferably permit free bodily pivotal movement of the entire clip involved.

Other objects, advantages, and features of the invention will become apparent upon making reference to the description to follow, the drawings, and the claims.

BRIEF DESCRIPTION OF DRAWINGS

FIGS. 1A, 1B, 1C, and 1D are a perspective view, a top plan view, a front elevational view, and a side elevational view, respectively, of the preferred version of the improved fuse holder;

FIG. 2 is a perspective view of the holder with a fuse inserted;

FIG. 3 is an exploded perspective view showing one end of the mounting base of the fuse holder with a clip positioned for insertion from above;

FIG. 4A and 4B are cross-sectioned side elevations showing details of the clip insertion and clip locking mechanism;

FIG. 5 is a top plan view in cross section showing rotation limiting engagement of the base of a fuse clip with the walls;

FIG. 6A is a cross-section partial front elevation of one end of a clip assembly wherein the fuse post has been crowned for increased pull strength;

FIG. 6B is a similar view of a conventional riveted fuse clip structure with the same metal-to-base insulation distance, showing the reduced height achieved with the improved structure for comparison purposes;

FIGS. 9A, 9B and 9C are respectively longitudinal sectional end and plan views of a modified fuse holder insulating base which is the most preferred form of the invention and which replaces the bases shown in the other FIGS. 1–6 and 8–9B.

DETAILED DESCRIPTION OF INVENTION

Figure 8:
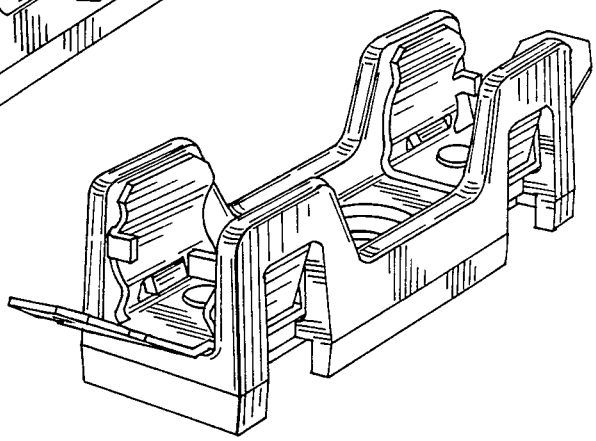
FIG. 8 is a perspective view of an alternative version of the fuse holder shown in FIG. 1C, wherein the terminal lugs extend upward and away from a mounting surface.

The exemplary form of the fuse holder invention is shown in FIGS. 1A, 1B, 1C, and 1D, and consists of a unitary insulation mounting base 1 and two conducting fuse holding clips 2 mounted on clip mounting areas at opposite ends of the mounting base. The base and the clips are configured to lockingly engage together under snap-in pressing engagement for facilitating automated assembly of the fuse holder. A central hole 4 in the base 1 allows passage of a mounting screw (not shown). Two connecting lugs 3 unitary with each clip 2 extend away from the mounting base 1. Each of the clips 2 are laterally confronted and partially shrouded by a pair of insulating barrier walls 5, which provide a measure of protection against accidental electrical contact of external objects with the clip structure. FIG. 2 shows a fuse holder with a cartridge fuse 6 installed. FIG. 8 shows an alternative of the fuse holder assembly shown in FIG. 1C, wherein the terminal lugs 3 extend upward and away from a mounting surface.

The barrier walls 5 further serve as part of the clip anchoring assembly. FIG. 3 shows details of a clip 2 positioned for insertion. The clip 2 is mounted on the base by pressing the clip downward between two compliant downwardly and inwardly inclining barrier wall locking tabs 7 (FIGS. 4A and 4B), forcing them outward until the clip is fully seated on the base. The bottom defining walls of horizontal locking slots 8 (FIGS. 3, 4A, 4B) in the bottom portions of the clip jaws are then held in place by the locking tabs. A unitary post 9 extending up from the base 1 engages a hole 10 in the base of the clip 2 to secure the clip against lateral motion.

Referring to FIG. 1C, it will be noted that the engaging slots 8 are configured longer than the width of the locking tabs 7, there by permitting the clips to rotate about the mounting posts 9 as shown in FIG. 5. The amount of rotation is restrained by close proximity of the interior surface of each of the walls 5 (FIG. 5) to the base of the clip 11, thereby holding the clip in proper alignment for fuse insertion and insuring that no substantial motion of the lug 3 can occur to cause an accidental short circuit to adjacent structures. For additional pull strength during fuse removal the posts may be crowned after assembly by conventional hot-forming methods well known to the art. FIG. 6A shows a cross-sectional view of a fuse clip 2 engaged by such a crowned post 12.

FIG. 6B shows a cross-section view of a prior art mounting base wherein a clip 2′ is secured to the base by a conventional metal rivet 13. This method of attachment places a conductor contacting a clip in close proximity to whatever mounting surface on which the fuse holder is attached, and thus reduces the maximum allowable voltage that may safely be applied to a clip before high voltage flashover occurs. By eliminating the rivet 13, a higher voltage rating fuse mount is achieved for a given base thickness and overall height, and may be seen by comparing FIG. 6B with FIG. 6A, wherein the metal-to-mounting plane distance D of both structures is held to the same standoff distance. The elements of the structure are all suited to well-known mass production techniques at competitive cost with respect to conventional fuse holders of similar type. The assembly is easily assembled, uses less parts by eliminating the rivets, and is self-aligning. This accomplishes several of the objects of the invention.

Figure 7:
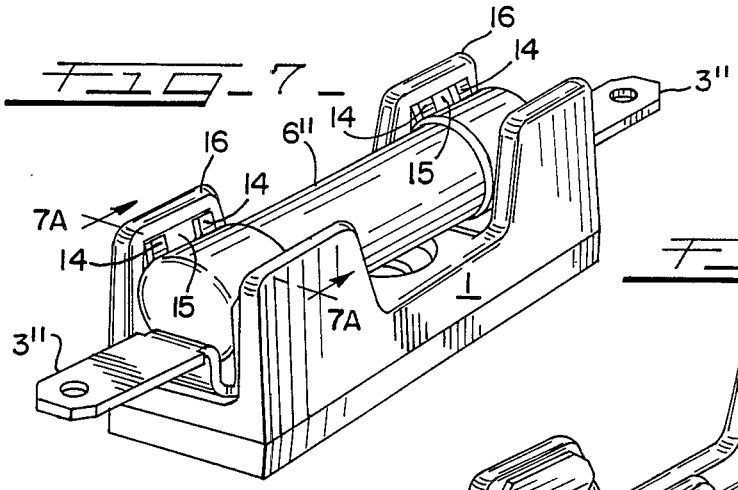
FIGS. 7 and 7A are respectively perspective and vertical sectional views of an alternative form of snap-in clip fuse mount of the invention.
Figure 7A:
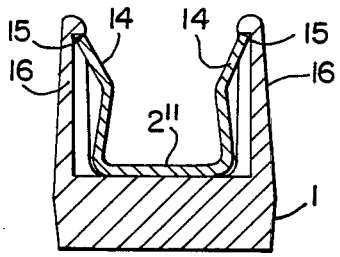

An alternate less desirable form of fuse holder is shown in FIGS. 7 and 7A. In this version the clips 2'' have tabs 14 on their jaw ends compliantly engaging beneath configured interior shoulders 15 on the barrier walls 16'' of a modified base 1''. The tabs are preferably spaced a small distance laterally from the barrier walls 16 to provide for horizontal pivotal play of the clips for self-alignment of the clips with mis-aligned fuse terminals. Also, the clips have outwardly flexible portions 14'—14' which expand upon fuse insertion. A capture post of the type previously described may optionally be employed, however, a high degree of compliance is necessary in the tabs 14 if significant rotation about the post is to be allowed.

Figure 9A:
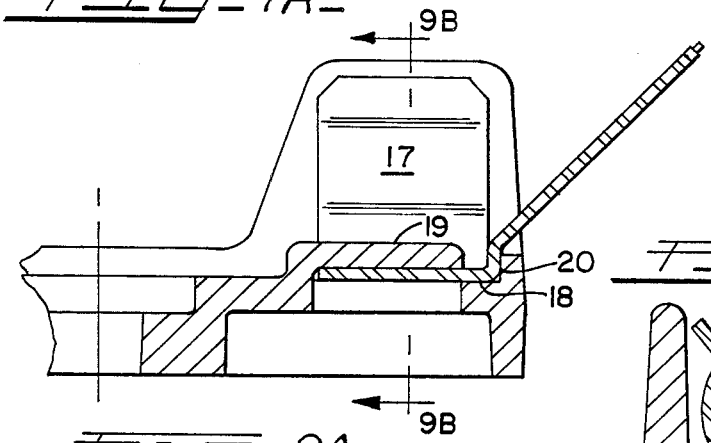
Figure 9B:
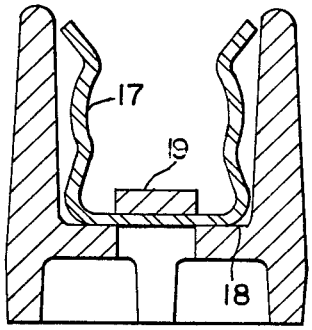

FIGS. 9A and 9B illustrate the commercial (best mode) form of the invention involving a modification of the mounting base of the fuse holder shown in FIGS. 1–6A which may be the same as previously described except for the addition of ribs 18—18. Thus, the modified mounting base 1''' shown in FIGS. 9A and 9B has barrier-forming walls 5'''—5''' with generally vertically extending ribs 18—18 on the confronting faces thereof. These ribs have a generally curved horizontal cross section as best shown in FIG. 9C. These ribs, which are shown as teardrop in shape, provide confronting curved surfaces which initially backup the clip fingers 14''' the outlines of which are shown in dashed lines in FIG. 9C. The curvature of these ribs permits the ready pivoting of the clips when forced to do so upon fuse insertion, to self-align the clips with respect to misaligned fuse terminals. The curved ribs provide a more snug snap-in fit of the clips relative to the form of the invention shown in the other Figures, where the snap-in function is carried out solely by the engagement of the clip with the locking tabs 7'''—7'''.

While for the purpose of illustration, various forms of this invention have been disclosed, other forms thereof may become apparent to those skilled in the art upon reference to this disclosure and, therefore, this invention shall be limited only by the scope of the appended claims. For example, the tabs are slots respectively shown from the barrier walls and clips could be reversed so that the tabs are on the clips and the slots are in the barrier walls, although the former design is preferred.

We claim:

1. In an open frame fuse holder for insertable electrical cartridge fuses having cylindrical coaxial end terminals, said holder comprising: an insulating unitary mounting base including a pair of spaced apart clip base support areas between which the terminal ends of a cartridge fuse are to extend; and a pair of U-shaped electrically conducting spring clips on said clip base support areas of said mounting base, each U-shaped clip including a base portion mounted on one of said clip base support areas and a pair of spaced apart confronting clip jaws with major jaw surfaces laterally facing one another, portions of each of said clip jaws configured with contours to springingly lockingly engage appreciable areas of a cylindrical fuse end terminal pressed between said jaws, the improvement wherein said mounting base has: a pair of electrically insulating clip-retaining barrier side walls disposed on opposite lateral sides of each of said clip support areas to present a laterally facing and clip-engaging wall face opposite each outer face of the associated clip jaw and each configured in height and length to act as an insulating protecting shield for at least a portion of the associated clip jaw, and clip-engaging portions of said barrier side walls being configured for locking snap-in engagement with matching contoured regions on the associated clip jaws while permitting expansion of the clip jaws upon insertion of a fuse end terminal therebetween, the clip-engaging portion of at least one of said pair of barrier side walls permitting relative pivotal movement of the entire associated clip; and pivot-forming means on the clip base support area of the mounting base adjacent the latter pair of barrier side walls for pivotally supporting the associated clip, the pivoting of the clip providing a self-aligning feature of the latter clip during fuse insertion, to reduce mechanical stress on the engaged fuse end terminal and to reduce electrical contact resistance therewith.

2. The fuse holder of claim 1 wherein said pivoting means comprises only a single insulating post unitary with said mounting base and arising therefrom, the base of said at least one clip having a hole passing through the major face thereof and configured to pivotally engage said post.

3. The fuse holder of claim 2 wherein said post is configured to extend above the top face of the base of said at least one clip to allow crowning deformation of the top of said post after assembly.

4. In an open frame fuse holder for insertable electrical cartridge fuses having cylindrical coaxial end terminals, said holder comprising an insulating unitary mounting base including a pair of spaced apart clip base support areas between which the terminal ends of a cartridge fuse are to extend; and a pair of electrically conducting U-shaped spring clips on said clip base support areas of said mounting base, each U-shaped clip including a clip base portion mounted on one of said clip base support areas, and a pair of spaced apart upstanding clip jaws with major jaw surfaces laterally facing one another, portions of each of said clip jaws configured with contours to springingly lockingly engage an appreciable area of cylindrical fuse end terminal pressed between said jaws, the improvement wherein said mounting base has a pair of electrically insulating, clip-retaining barrier side walls disposed on opposite lateral sides of each of said clip support areas to present a laterally facing and clip-engaging wall face opposite each outer face of the associated clip jaw, each of said barrier side walls being configured in height and length to act as an insulating protecting shield for at least a portion of the associated clip jaw, and the confronting portions of each of said pair of barrier side walls and the associated clips having snap-in clip engaging means for lockingly retaining the associated clip upon the mounting base while permitting expansion of the clip jaws upon insertion of a fuse end terminal therebetween.

5. The fuse holder of claim 1 or 4 wherein the clip engaging portions of each of said pair of barrier side walls comprise locking tab means unitary with one of said barrier side walls and clips for engaging locking regions on the other of same and configured lockingly to engage by snap-in engagement the associated clip when the clip base thereof is pressed against a clip support area.

6. The fuse holder of claim 1 wherein the clip engaging portions of at least one of said pair of barrier side walls comprise locking tab means unitary with said barrier side walls for engaging a locking region on the associated clip, the slip locking regions of the associated clip including elongated slots in the clips involved, the bottom defining walls of which slots are confronted by tab means on the associated barrier side walls, which tab means retain the clip on the mounting base, each slot being disposed with its major axis perpendicular to the pivot axis of the clip to facilitate pivoting of said at least one clip on said associated support area.

7. The fuse holder of claim 1 or 4 wherein the clip engaging portions of at least one of said pair of barrier side walls comprise locking tab means unitary with said barrier side walls for engaging a locking region on the associated clip, the clip locking regions of the associated clip including elongated slots in the clips involved, the bottom defining walls of which slots are retained by tab means on the associated barrier side walls, which tab means bear down thereupon.

8. The fuse holder of claim 1 further wherein the interior faces of said pair of barrier side walls of at least one of said clips being configured and disposed to limit the pivoting of said clip by engagement with a portion of said clip.

* * * * *